US006473574B1

(12) United States Patent
Usui et al.

(10) Patent No.: US 6,473,574 B1
(45) Date of Patent: Oct. 29, 2002

(54) IMAGE FORMING APPARATUS WITH PLURAL TRANSFER MEANS AND SELECTING MECHANISM FOR SELECTING FROM AMONG A PLURALITY OF IMAGE BEARING MEMBERS

(75) Inventors: Masatake Usui, Numazu; Akihiko Takeuchi, Susono; Hideyuki Yano, Mishima; Akihiko Uchiyama; Kazuhiro Funatani, both of Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/558,170

(22) Filed: Apr. 26, 2000

(30) Foreign Application Priority Data

| | | |
|---|---|---|
| Apr. 28, 1999 | (JP) | 11-121594 |
| Apr. 28, 1999 | (JP) | 11-121595 |
| Oct. 4, 1999 | (JP) | 11-283564 |
| Apr. 21, 2000 | (JP) | 2000-121445 |

(51) Int. Cl.[7] ..... G03G 15/16; G03G 21/00

(52) U.S. Cl. ..... 399/66; 399/99; 399/101; 399/299; 399/302; 399/303

(58) Field of Search ..... 399/101, 99, 66, 399/299, 302, 303, 312, 310, 314, 313

(56) References Cited

U.S. PATENT DOCUMENTS

| | | | | |
|---|---|---|---|---|
| 5,153,654 A | | 10/1992 | Yuminamochi et al. | |
| 5,264,902 A | | 11/1993 | Suwa et al. | |
| 5,523,829 A | | 6/1996 | Miyashiro et al. | |
| 5,809,373 A | * | 9/1998 | Yoda et al. | 399/101 |
| 5,899,610 A | | 5/1999 | Enomoto et al. | 399/302 |
| 5,974,281 A | | 10/1999 | Fujii et al. | 399/66 |
| 5,995,793 A | | 11/1999 | Enomoto et al. | 399/302 |
| 6,026,268 A | | 2/2000 | Shiozawa et al. | 399/297 |
| 6,049,681 A | * | 4/2000 | Shiozawa et al. | 399/66 X |
| 6,175,702 B1 | * | 1/2001 | Takeuchi et al. | 399/101 |
| 6,192,207 B1 | * | 2/2001 | Yamamoto et al. | 399/299 X |

FOREIGN PATENT DOCUMENTS

| | | |
|---|---|---|
| JP | 63-97980 | 4/1988 |

* cited by examiner

*Primary Examiner*—Susan S. Y. Lee
(74) *Attorney, Agent, or Firm*—Fitzpatrick, Cella, Harper & Scinto

(57) ABSTRACT

An image forming apparatus includes a plurality of image bearing members for respectively bearing toner images, a moving member, a plurality of transfer devices for electrostatically transferring a toner image on each of the image bearing members onto the moving member or a transfer material borne by the moving member, a plurality of collecting devices for respectively collecting toner on each image bearing member, a selecting device for selecting an image bearing member to which toner on the moving member is to be transferred to the plural image bearing members.

60 Claims, 9 Drawing Sheets

IMAGE FORMING APPARATUS WITH PLURAL TRANSFER MEANS AND SELECTING MECHANISM FOR SELECTING FROM AMONG A PLURALITY OF IMAGE BEARING MEMBERS

BACKGROUND OF THE INVENTION

1. Field of the Invention

The present invention relates to an image forming apparatus using an electrophotographic process, and relates to an image forming apparatus such as a copying machine, a printer or a facsimile machine.

2. Related Background Art

Speeding up, sophistication and colorization of an image forming apparatus using an electrophotographic process have been recently advanced, and a copying machine, a printer and a facsimile machine adopting various modes have been used.

Among others, an image forming apparatus adopting an in-line mode, in which image forming units for forming toner images having multiple different colors are arranged in parallel in a direction for conveying a transfer material born by a transfer belt as transfer material bearing members and the toner images are sequentially multi-transferred from a plurality of the image bearing members to the transfer material, can form an image at a high speed, and hence it can be considered to be a main product in future. Besides such an image forming apparatus, there is also proposed a process, in which image forming units for forming multiple different color toner images are arranged in parallel in a direction along which an intermediate transfer belt as an intermediate transfer member moves and the toner images are sequentially multi-transferred from a plurality of image bearing members to the intermediate transfer member so that the toner images on the intermediate transfer belt are then collectively transferred on the transfer member.

In such an image forming apparatus, when the toner remains on or adheres to the surface of the transfer belt or the intermediate transfer belt, this can be a cause of an defective image unless any type of cleaning is carried out to remove such toner. There is proposed a cleaning device in which a blade for scraping off the toner remaining on or adhered to the surface of the transfer belt or the intermediate transfer belt in contact with the transfer belt or the intermediate transfer belt is disposed so that the scraped-off unnecessary toner is collected in a waste toner tank.

Further, there is also proposed an image forming apparatus such that the process cartridge having at least the image bearing member, the cleaning device and the waste toner tank is integrally constituted and the process cartridge can be attached to or detached from the apparatus main body. This structure is adopted in order to facilitate the replacement by a user when the life duration of the image bearing member is ended. In such an image forming apparatus, since the waste toner tank can be also replaced when changing the process cartridge, this apparatus is superior in the usability.

Furthermore, there is also proposed a system by which the toner adhered to the transfer belt or the intermediate transfer belt is electrostatically transferred to one specific image bearing member among a plurality of image bearing members each time without using the above-described cleaning device for scraping off the toner adhered to the transfer belt or the intermediate transfer belt and the transferred toner is collected by a cleaning device for the image bearing member.

In the above-described image forming apparatus, since the toner remaining on or adhered to the transfer material bearing member or the intermediate transfer member has the electrostatic charge of a normal charging polarity as well as the electrostatic charge of the polarity which is opposite from the above polarity and no electrostatic charge at all by an effect of a transfer electric field or the like, the toner remaining on or adhered to the transfer material bearing member or the intermediate transfer member is unable to be completely transferred to the specific image bearing member to be collected. Consequently, a fouling back of the transfer material or a defective image might occur.

Further, in the above-described image forming apparatus using the plural image bearing members, the toner remaining on or adhered to the transfer material bearing member or the intermediate transfer material is collected in the waste toner tank of the cleaning device for a specific image bearing member, which degrades the efficiency of use of the waste toner tank. That is, the waste toner tank for the specific image bearing member becomes full excessively earlier than the waste toner tank of any other image bearing member, and the waste toner tank must be frequently replaced, thereby lowering the usability.

In addition, in an image forming apparatus having a plurality of the process cartridges, since the waste toner tank of the cleaning device provided in a specific process cartridge becomes full excessively earlier before the unspent toner accommodated in the specific process cartridge is completely used up or before the life duration of a photosensitive drum is expired, the process cartridge must be replaced with a new one or a replacement timing of the specific process cartridge comes excessively earlier than that of any other process cartridge.

SUMMARY OF THE INVENTION

It is an object of the present invention to provide an image forming apparatus capable of excellently cleaning the toner on a moving member.

Other objects of the present invention will be understood in conjunction with the following detailed description.

DESCRIPTION OF THE PREFERRED EMBODIMENTS

Embodiment 1

Figure 1:
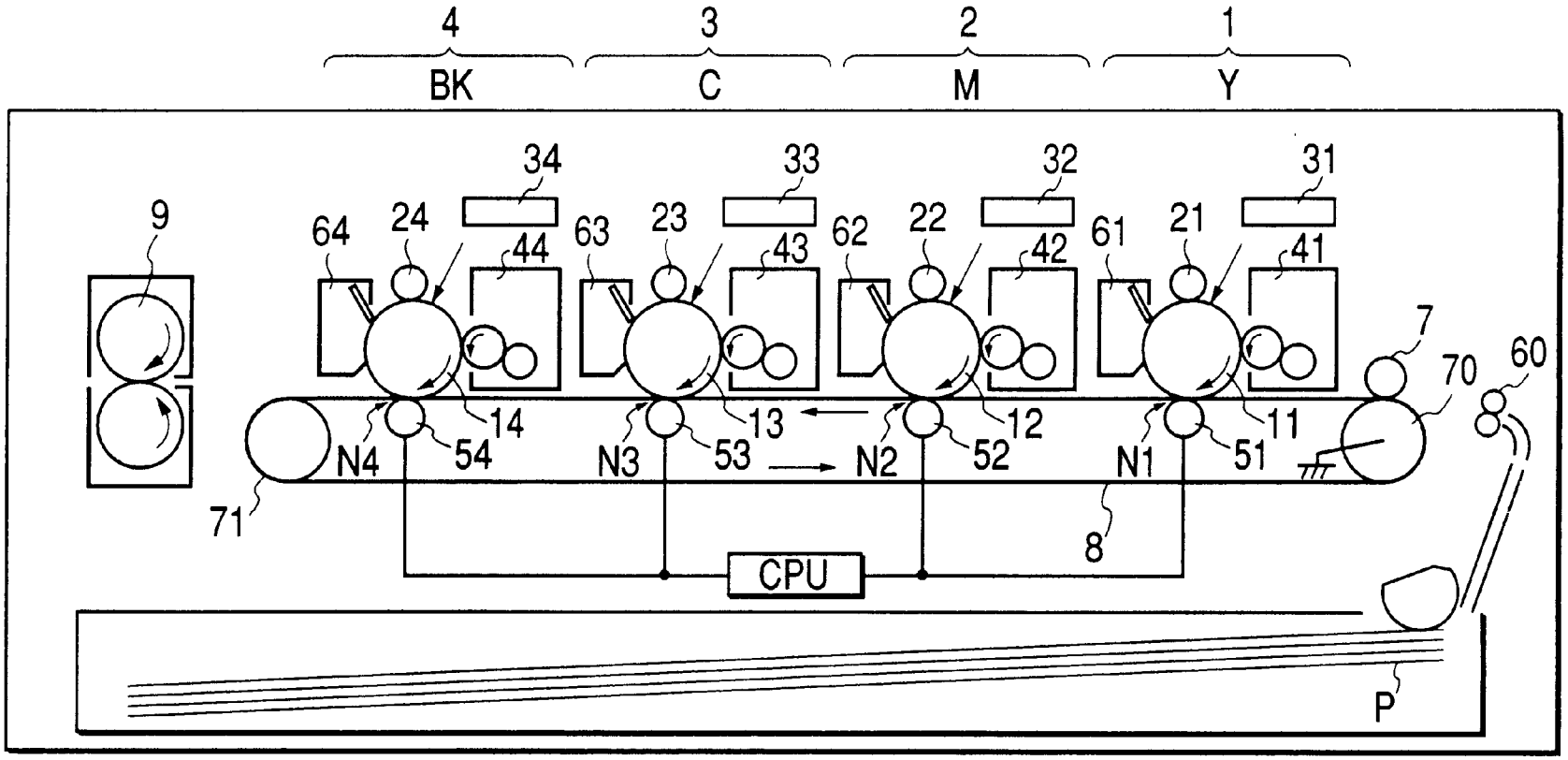
FIG. 1 is a schematic cross-sectional view showing an image forming apparatus according to an embodiment 1.

FIG. 1 is a schematic cross-sectional view showing a color image forming apparatus using an electrophotographic process. Four independent process cartridges 1 to 4 which can be attached to and detached from the apparatus main body and has photosensitive drums as image bearing members for Y (yellow) toner, M (magenta) toner, C (cyan) toner and Bk (black) toner, developing devices as developing means, and cleaning devices as collecting means are arranged in parallel and transfer is sequentially carried out to a transfer material P attracted to a transfer belt as a transfer material bearing member in the superimposing manner, thereby obtaining a full-color image.

Reference numerals 11 to 14 in FIG. 1 denote repeatedly used rotary drum type electrophotographic photosensitive members (which will be referred to as photosensitive drums hereinafter) which are driven to rotate in an illustrated clockwise direction at a predetermined peripheral speed (process speed).

The photosensitive drums 11 to 14 are uniformly subjected to the charging process so as to have a predetermined polarity/potential (negative in this embodiment) in the rotating step by primary charging rollers 21 to 24 and then image-exposed by image exposing means 31 to 34 (constituted by a laser diode, a polygon scanner, a lens group and others), thereby forming electrostatic latent images corresponding to first to fourth color component images (for example, yellow, magenta, cyan and black component images) of a target color image, respectively.

Thereafter, the electrostatic latent images are developed by a developing unit in each station. Respective developing sleeves bearing toners within the developing devices 41 to 44 (yellow, magenta, cyan and black) for containing respective color toners therein are caused to rotate in a direction indicated by arrows in FIG. 1 by non-illustrated driving devices and they are so disposed as to be opposed to the photosensitive drums in the developing process. Each color toner which is frictionally charged to be negative in the associated developing device and borne by the associated developing sleeve is electrostatically transferred on the associated photosensitive drum, thus forming toner images having respective colors.

A transfer belt 8 is driven to rotate at a peripheral speed substantially equal to that of the photosensitive drums 11 to 14 in the direction indicated by arrows while coming into contact with the respective photosensitive drums 11 to 14.

A transfer material P fed from a sheet cassette is further fed toward an attracting nip section made up of the transfer belt 8 and an attracting roller 7 with a predetermined timing by a registration roller pair 60 and electrostatically attracted to the transfer belt 8. At this time, a predetermined voltage is applied to the attracting roller 7 in order to cause the transfer material P to be electrostatically attracted to the transfer belt 8.

The attracting roller 7 is obtained by molding solid rubber on a core metal having a diameter of 6 mm and a high-voltage bias for attraction can be applied to the core metal. The attracting roller 7 is a solid rubber roller having a diameter of 12 mm in which carbon black is dispersed to an EPDM rubber for resistance adjustment, and its resistance value is adjusted to be approximately $10^5$ Ω when a metal foil having a width of 1 cm is wound around the roller and a voltage of 500 V is applied between the metal foil and the core metal.

The one of the toner images of different colors is transferred from the photosensitive drums onto the transfer material P attracted to the transfer belt 8 every time the transfer material P passes through each process cartridge (each image forming station). At a separation position where the transfer belt 8 comes into contact with the roller 71, the transfer material P subjected to the curvature separation has the full-color toner image fixed by the fixing device 9 and is ejected from the apparatus.

After the images are transferred from the photosensitive drums 11 to 14 to the transfer material P on the transfer belt 8, the toner remaining on the photosensitive drums 11 to 14 is removed and collected by cleaning blades of cleaning devices 61 to 64. The removed toner is accumulated in the waste toner tanks within the respective cleaning devices 61 to 64.

The following will describe how to collect the residual toner remaining on, adhered to or formed on the transfer belt 8 used in this embodiment.

In order to control an image density, there is provided a density control mode by which a toner image for testing which is formed on the photosensitive drum is intentionally transferred to the transfer belt 8 and a density of this toner image for testing is detected by an optical sensor and the like so that the density of the toner image formed on the photosensitive drum is controlled based on the density detection result. The toner is formed on, adhered to or remains on the transfer belt 8 when the fogging toner of the photosensitive drum is adhered to the transfer belt between the transfer material P and another transfer material P during the continuous image formation or when the toner is adhered due to accidental jamming of the transfer material P and the like. This can lead to the work-up (smear) of an image or a defective image in the subsequent image formation process. Such remaining, adhered or formed toner (which will be generically referred to as residual toner hereinafter) is collected in the waste toner tank in the process cartridge.

Further, in the above-described image forming apparatus, the respective color toner images may be misregistered and formed on the transfer material, and this may provoke a variation in hue or tone. Taking into account a moving speed of the transfer belt 8 and distances (N1 to N2, N2 to N3, N3 to N4) between the transfer positions of the respective process stations, there is provided a registration control mode by which the registration detection is performed in order that the transfer is enabled at the respective process stations with a timing such that the positions of the respective color toner images formed on the transfer material P are registered with each other, thereby preventing the misregister.

As a method for carrying out the registration detection, plural lines parallel to main scanning directions formed on the respective photosensitive drums 11 to 14 are transferred on the transfer belt 8 as registration detection patterns before transferring the toner images on the transfer material.

Further, an optical sensor is provided in the image forming apparatus so as to be opposed to the transfer belt 8 in order to detect a central position of a line of the registration detection pattern. Based on a detection result by the optical sensor, the registration position control of each color image is carried out by adjusting the writing timing of the latent images onto the photosensitive drums if necessary.

As described above, since the toner image is transferred onto the transfer belt 8 in the registration detection, the transfer belt 8 can be refreshed by carrying out the above-mentioned cleaning after detection even in such a case.

In this embodiment, an amount of the residual toner to be collected is changed by the process cartridges for each operation in such a manner that the residual toner can be relatively uniformly collected in the waste toner tanks 61 to 64.

For example, when a large amount of the residual toner is first collected by the process cartridge 1, a large amount of the residual toner is collected by the process cartridge 2 in the next operation, and a large amount of the residual toner is collected by the process cartridge 3 in the following operation. A large amount of the residual toner is collected by the process cartridge 4 in the next operation, and a large amount of the residual toner is again collected by the process cartridge 1 in the subsequent operation.

These controls are enabled by controlling the transfer bias to the transfer rollers 51 to 54, the charging bias of the primary charger, and the exposing operation of the exposure means. In case of collecting the residual toner, the potential of the photosensitive drums is set to substantially zero by exposure using exposing means, and a voltage of −1 kV is applied to the transfer roller. When the residual toner is not collected, the potential of the photosensitive drums is set to substantially −550V (potential equal to that in the normal image formation) by the primary charger and no voltage is applied to the transfer rollers.

In this manner, appropriate change of the process cartridges for collecting the residual toner can prevent the residual toner from being biasedly collected to the waste toner tank in a specific process cartridge.

It is to be noted that collection of the residual toner is not necessarily restricted to one process cartridge in the residual toner collection mode and the residual toner may be collected by two or three process cartridges without any problem.

For example, the CPU can be used to control in such a manner that, when the residual toner is first collected by the process cartridges 1 and 2, the residual toner may be then collected by the process cartridges 2 and 3 in the next operation. The process cartridges 3 and 4 may be used to collect the residual toner in the subsequent operation, and the residual toner may be collected by the process cartridges 4 and 1 in the next operation. Further, in the following operation, the residual toner may be collected by again using the process cartridges 1 and 2.

With such a structure, in the inline type image forming apparatus having a plurality of process cartridges, since an amount of each color toner consumption differs depending on the usage conditions, the timing for replacing the process cartridge for a lack of the toner becomes irregular. When the process cartridge which is short of the toner is replaced one by one, the waste toner tank may be full if an amount of the toner consumption is excessively biased.

As a countermeasure, it is further preferable that a mechanism (optical sensor) for detecting an amount of the waste toner collected to the waste toner tank is provided and the CPU as the controlling means is caused to select which waste toner tank is to collect the residual toner based on the detection result by the detection mechanism. This structure can prevent only a specific waste toner tank from being full excessively earlier than other waste toner tanks and also the specific process cartridge from being replaced even though the unused toner still remains.

In addition, as an emergency measure, the residual toner is not collected to the waste toner tank which is full of the waste toner but the other process cartridges are used to collect the residual toner before a user purchases and replaces a process cartridge, thereby forming only a toner image having a given color (for example, when the waste toner tank for Y toner is full, a monochrome image can be formed). Moreover, when it is informed that the waste toner tank is full of the waste toner from a detection result by the detection mechanism, the CPU may show a replacement instruction on a display (in case of a printer, it may be displayed on a PC screen through a connection cable) to prevent any trouble from occurring, thus improving the usability.

Further, as means for determining the cartridge to collect the residual toner, a mechanism for detecting an amount of the waste toner is not provided but a mechanism for detecting a remaining amount of the unused toner in the developing device may be provided in order to select a process cartridge (a photosensitive drum, a waste toner tank) to collect the toner on the transfer belt from the detection result of this detection mechanism. When comparing an amount of the transfer residual toner, which has not been transferred on the transfer material on the transfer belt, remaining on the photosensitive drums which is to be essentially collected with an amount of the residual toner on the transfer belt, an amount of the transfer residual toner to be essentially collected is greater. Therefore, the unused toner in the developing device can be correlated with the toner collected in the waste toner tank. When the correlation value is previously inputted in a memory (ROM) as storing means, the CPU can select which photosensitive drum is to collect the residual toner based on the detection result of the remaining amount of the unused toner.

Further, a counter which can count a number of times (number of sheets on which images were formed) the image formation operations were carried out may be provided in each cartridge so that the CPU can determine a photosensitive drum to which the residual toner on the transfer belt is to be collected. When comparing an amount of the transfer residual toner on the photosensitive drum which is to be essentially collected with an amount of the residual toner on the transfer belt, the amount of the transfer residual toner on the photosensitive drum is greater. Therefore, the counted value can be correlated with the amount of the toner collected in the waste toner tank. Furthermore, if the counted value of each cartridge exceeds a fixed count, the residual toner on the transfer belt can be made not to be collected to the photosensitive drum of that cartridge.

Additionally, there is another method by which an amount of the used toner having each color is calculated from the image data having each color component and a photosensitive drum (cartridge) which is to collect the residual toner on the transfer belt is selected based on this calculated value. When comparing an amount of the transfer residual toner on the photosensitive drum which is to be essentially collected with an amount of the toner on the transfer belt, the amount of the transfer residual toner on the photosensitive drum is greater. Therefore, the amount of the used toner can be correlated with the toner collected in the waste toner tank.

That is, the CPU selects a photosensitive drum which is to collect the residual toner on the transfer belt on the image data. If an integrated value of the amount of the used toner obtained by the image data exceeds a fixed amount, it is possible to set that the residual toner on the transfer belt is not collected in that cartridge.

In case of providing no mechanism for detecting an amount of the waste toner in the waste toner tank, some of the above-described methods can be combined to be used.

Although a cartridge to collect the residual toner on the transfer belt is switched by using the detecting means for detecting an amount of the waste toner collected in the waste toner tank of each cartridge in this embodiment, the purpose of the present invention is not limited by this means, and any other means can be used to determine a cartridge effecting collection.

As described above, according to this embodiment, in the inline color image forming apparatus using the transfer material bearing member, there is such a merit as that the residual toner can be prevented from being biasedly collected to the waste toner tank in a specific process cartridge and a plurality of the waste toner tank can be effectively utilized.

Embodiment 2

Figure 2:
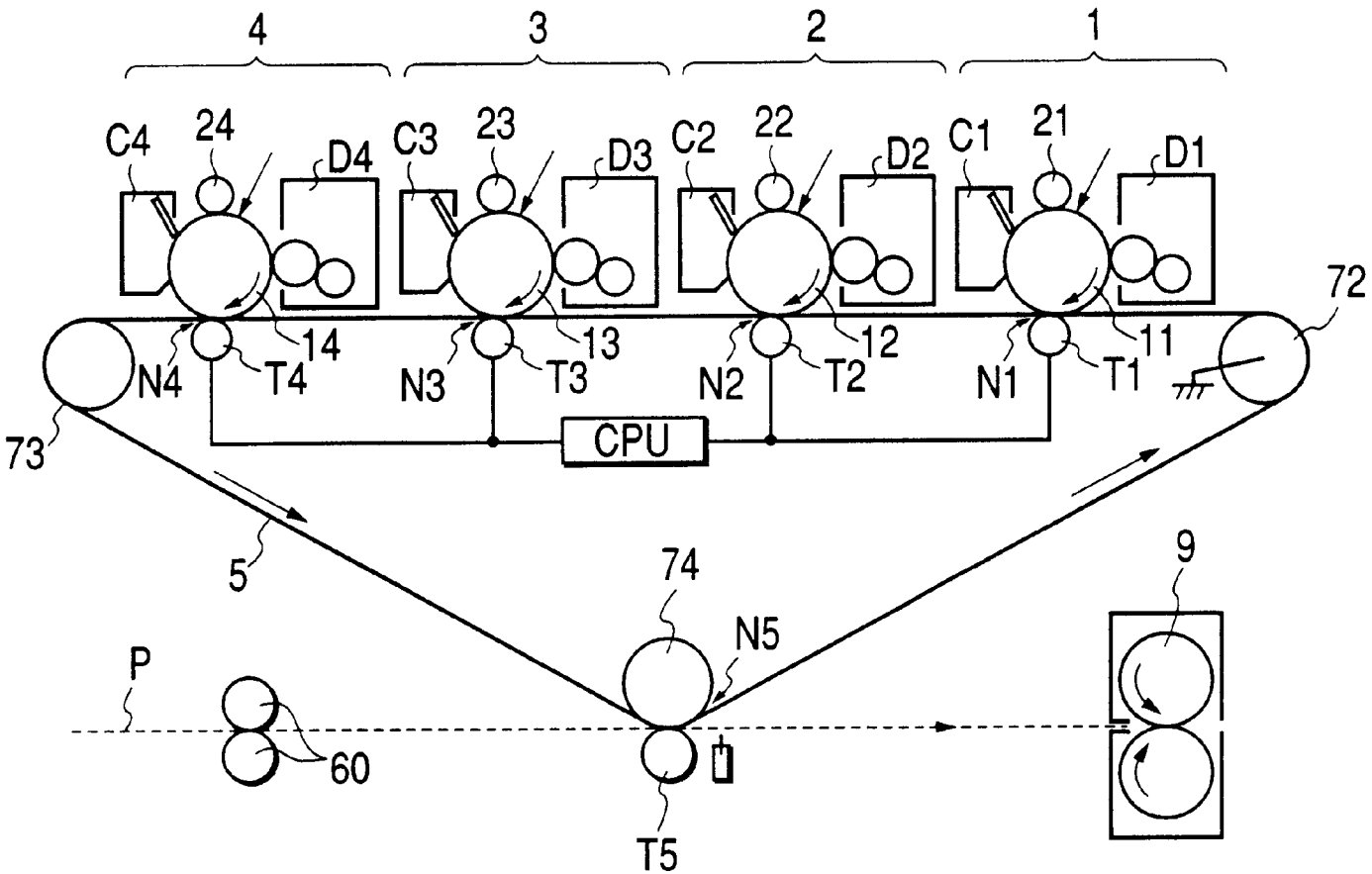
FIG. 2 is a schematic cross-sectional view showing an image forming apparatus according to an embodiment 2.

FIG. 2 shows a schematic structure of an image forming apparatus according to an embodiment 2. It is to be noted that this drawing illustrates a full-color image forming apparatus having four colors which arranges therein a plurality of image forming stations (process cartridges) in series and has an intermediate transfer belt as an intermediate transfer member.

With reference to FIG. 2, description will now be given on the structure of the image forming apparatus and an outline of the image forming process. Here, reference numerals 1 to 4 denote process cartridges each including developing devices as developing means for Bk toner, M toner, C toner and Y toner, a photosensitive drum as an image bearing member, a charging device and a cleaning device as collecting means. Image information associated with each color component is written as optical information on photosensitive drums 11 to 14 included in the respective process cartridges, thereby forming electrostatic latent images. The electrostatic latent images for the respective components are visualized by developers D1 to D4 having respective colors in the developing portions. The visualized toner image on each photosensitive drum sequentially electrostatically transferred by primary transfer rollers T1 to T4 in primary transfer sections N1 to N4 where the intermediate transfer member 5 comes into contact with the respective photosensitive drums 11 to 14. During the toner image transfer, the primary transfer rollers T1 to T4 come into contact with the back surface of the intermediate transfer member 5 so that a voltage (positive) having a polarity opposite from a normal charging polarity of the toner is applied to these rollers. The full-color toner images on the intermediate transfer member 5 which have been sequentially transferred in the primary transfer sections N1 to N4 are collectively transferred on a transfer material P fed and carried from a registration roller 60 in timing by a secondary transfer roller T5 in a secondary transfer section N5, and the transfer material P is then curvature-separated from the intermediate transfer member 5 and conveyed to a fixing device 9 where it is heated and pressurized to be fixed.

Description will now be given as to how to collect the residual toner on the intermediate transfer belt 5 which has remained on, adhered to or been formed on the intermediate transfer belt 5 used in this embodiment.

As similar to the embodiment 1, when transferring a toner image for detection onto the intermediate transfer belt 5 as a registration detection pattern for the image density control or the registration detection, or when the fogging toner of the photosensitive drum adheres to the intermediate transfer belt between an image and an image during a continuous image formation, or when the toner adheres to the intermediate transfer belt due to any accidental cause such as jam of the transfer material P, the toner is formed, remains or adheres on the intermediate transfer belt 5.

This can cause an image defect in the subsequent image formation processes. Such toner which has remained, adhered or been formed (which will be generically referred to as residual toner hereinafter) is collected to waste toner tanks in the process cartridges as similar to the foregoing embodiment 1.

In this embodiment, an amount of the residual toner to be collected is changed over by each process cartridge in each operation so that the residual toner can be relatively uniformly collected in waste toner tanks C1 to C4.

For example, when a large amount of the residual toner is first collected by the process cartridge 1, a large amount of the residual toner is collected by the process cartridge 2 in the next operation, and a large amount of the residual toner is further collected by the process cartridge 3 in the following operation. Also, a large amount of the residual toner is collected by the process cartridge 4 in the subsequent operation, and a large amount of the residual toner is again collected by the process cartridge 1 in the next operation.

These controls are enabled by controlling the transfer bias of the transfer rollers T1 to T4, the charging bias of the primary charger, and the exposing operation of the exposure means. When collecting the residual toner, the potential of the photosensitive drums is set to 0V by exposure using the exposing means and a voltage of −1 kV is applied to the transfer rollers. In case of collecting no residual toner, a primary charger is used to set the potential of the photosensitive drum to −550V (potential in the normal image formation) and no voltage is applied to the transfer rollers.

In this manner, appropriate changeover of the process cartridge for collecting the residual toner can prevent the residual toner from being biasedly collected to the waste toner tank in a specific process cartridge.

It is to be noted that collection of the residual toner in the residual toner collection mode does not have to be limited to use of one process cartridge. No problem occurs even if the residual toner is collected by using two or three process cartridges.

The CPU may control to enable the following operation. That is, for example, when the residual toner is first collected by the process cartridges 1 and 2, the residual toner is collected by the process cartridges 2 and 3 in the next operation, and the residual toner is collected by the process cartridges 3 and 4 in the subsequent operation. Further, the residual toner is collected by the process cartridges 4 and 1 in the next operation, and the residual toner is again collected by the process cartridges 1 and 2 in the following operation.

The intermediate transfer belt 5 used herein is formed of a polyimide resin film and has a single layer structure having a value of volume resistivity of approximately $10^9$ Ω·cm and a thickness of 150 μm.

In case of the above-described structure, since an amount of each color toner consumption differs depending on the use conditions in the inline type image forming apparatus having a plurality of image forming stations (process cartridges), the timing for replacing the process cartridge which is short of toner becomes irregular. If the process cartridges which are short of toner are sequentially replaced, the waste toner tank may be full when an amount of the toner consumption is excessively biased.

As a countermeasure, it is further preferable that a mechanism (optical sensor) for detecting an amount of the waste toner collected in the waste toner tank is provided and the CPU as the controlling means selects which waste toner tank collects the residual toner based on the detection result of the detection mechanism. Such a structure can prevent only a specific waste toner tank from being full earlier than other waste toner tanks and also the specific process cartridge from being replaced even though the unused toner still remains.

Additionally, as an emergency measure, the residual toner is not collected to the waste toner tank which is full of the waste toner but the other process cartridges are used to collected the residual toner before a user purchases and replaces a process cartridge, thereby forming a toner image having a given color (for example, when the waste toner tank for the Y toner is full, a monochromatic image can be formed). Moreover, when it is informed that the waste toner tank is full of the waste toner based on the detection result by the detection mechanism, the CPU can show a replacement instruction on a display (in case of a printer, it may be displayed on a PC screen through a connection cable) to prevent any trouble from occurring, thus improving the usability.

Further, a mechanism for detecting an amount of the waste toner in the waste toner tank to determine a cartridge to collect the residual toner is not provided but, for example, a mechanism for detecting a remaining amount of the unused toner in the developing device may be provided so that the CPU can select a process cartridge (the photosensitive drum, the waste toner tank) which is to collect the residual toner on the intermediate transfer belt based on the detection result of the detection mechanism. When comparing an amount of the transfer residual toner which remains on the photosensitive drum without being transferred onto the intermediate transfer belt and which is essentially to be collected with an amount of the residual toner on the intermediate transfer belt, the amount of the transfer residual toner on the photosensitive drum which is to be essentially collected is greater. Therefore, the unused toner in the developing device can be correlated with the residual toner collected in the waste toner tank. If the correlation value is previously stored in a memory (ROM), the CPU can select which toner tank is to collect the residual toner based on the detection result of a remaining amount of the unused toner.

Moreover, a counter which can count a number of times (a number of sheets on which images have been formed) the image formation operation has been performed may be provided in each cartridge, and the CPU may determine a photosensitive drum which is to collect the residual toner on the intermediate transfer belt based on a counted value. When comparing an amount of the transfer residual toner on the photosensitive drum which is to be essentially collected with an amount of the residual toner on the intermediate transfer belt, the amount of the primary transfer residual toner on the photosensitive drum is greater. Therefore, a counted value can be correlated with an amount of the toner collected in the waste toner tank. Further, if the counted value of each cartridge exceeds a fixed count, it is possible to set that the residual toner on the intermediate transfer belt is not collected to the photosensitive drum of that cartridge.

Further, as still another method, an amount of the used toner having each color may be calculated based on the image data having each color component and the CPU may select a photosensitive drum (cartridge) which is to collect the residual toner on the intermediate transfer belt based on the calculated value. Comparing an amount of the transfer residual toner on the photosensitive drum which is to be essentially collected with an amount of the toner on the intermediate transfer belt, the amount of the transfer residual toner on the photosensitive drum is larger. Therefore, the amount of the used toner and the amount of the toner collected in the waste toner tank can be correlated with each other.

That is, a photosensitive drum which is to collect the residual toner on the intermediate transfer belt is selected based on the image data. When an integrated value of the amount of the used toner obtained from the image data exceeds a fixed amount, it is possible to determine that the toner on the intermediate transfer belt is not collected in that cartridge.

Further, if a mechanism for detecting an amount of the waste toner in the waste toner tank is not provided, some of the above-mentioned methods can be combined and used without any problem.

Although a characteristic of this embodiment lies in that the detecting means for detecting an amount of the waste toner in the waste toner tank in each cartridge is used to change over a cartridge which is to collect the toner on the intermediate transfer belt, the purpose of the invention is not limited by this means and any other means can be used to determine a cartridge which is to perform collection.

As described above, in the inline color image forming apparatus using the intermediate transfer member, this embodiment has such a merit as that the residual toner on the intermediate transfer member can be relatively uniformly allocated and collected and the waste toner tank can be effectively used.

Embodiment 3

Although the above-mentioned embodiment 1 presupposes that the charging polarity of most of the residual toner on the transfer belt 8 is a negative polarity, there is the residual toner charged to have an opposite polarity or no polarity due to the affection of the transfer electric field and others, this embodiment intends to excellently clean even such residual toner whose charging polarity is not negative.

Figure 3:
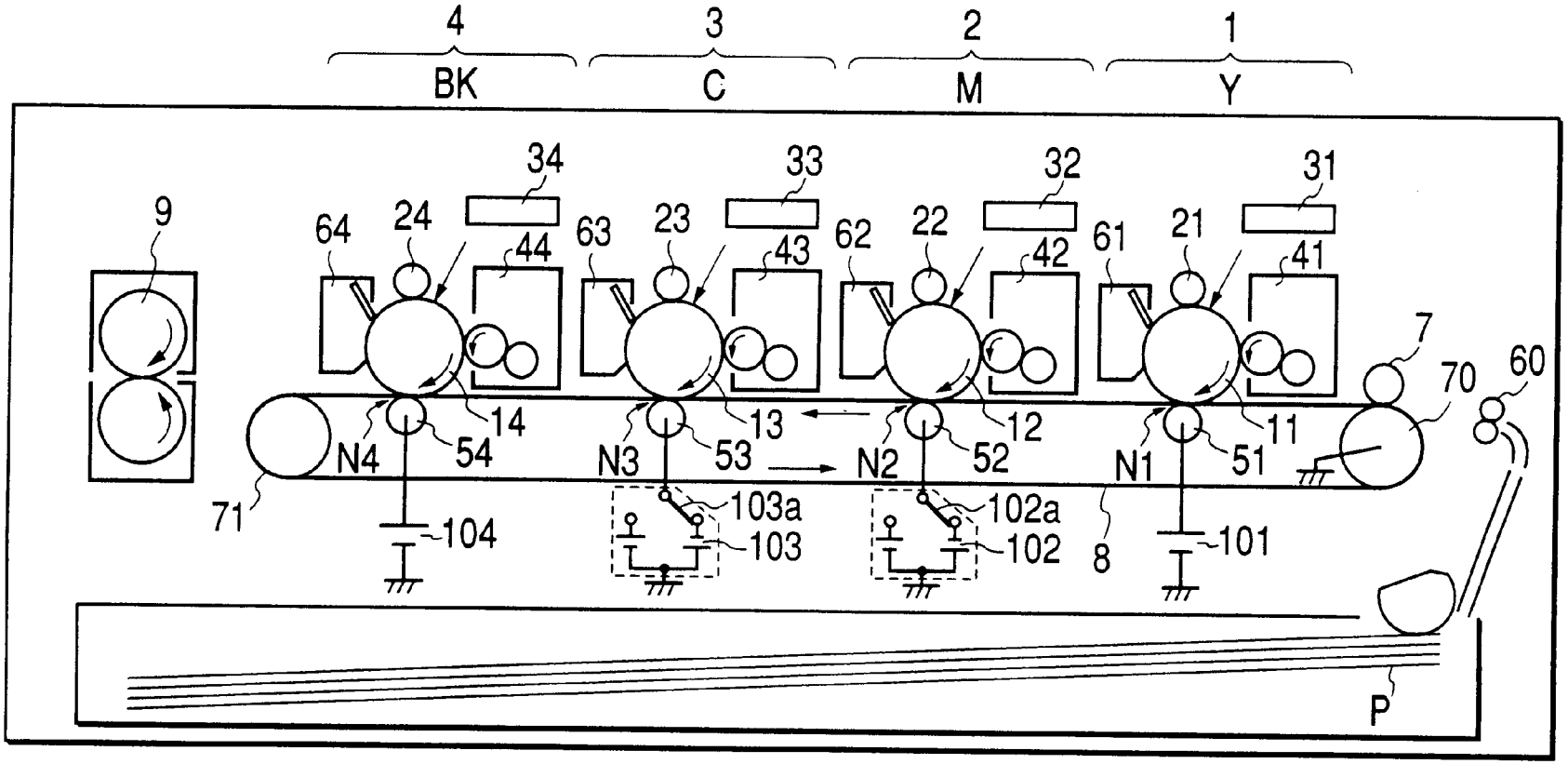
FIG. 3 is a schematic cross-sectional view showing an image forming apparatus according to an embodiment 3.

FIG. 3 shows an image forming apparatus according to this embodiment, and like reference numerals denote parts similar to those in FIG. 1, thereby avoiding the tautological explanation.

This embodiment is characterized in that the residual toner on the transfer belt 8 is collected in the waste toner tanks in at least two process stations, i.e., directions of cleaning electric fields for transferring the residual toner on at least two photosensitive drums are caused to be opposed.

Collection of the residual toner will now be described in detail hereunder.

At first, a sub cleaning bias (positive) having the same polarity as the polarity (positive) during transfer is applied by a power supply 101 to a transfer roller 51 in a process station 1 on the uppermost stream side along the rotating direction of a transfer belt 8, and the residual toner having an opposite polarity (positive) is transferred onto a photosensitive drum 11 to be collected to a waste toner tank in the process station 1 whilst the residual toner on the transfer belt 8 is charged to have a normal polarity (negative).

At second, in a process station 2, a main cleaning bias (negative) whose polarity (negative) is opposite from the polarity (positive) during transfer is applied to a transfer roller 52 by changing over a switch 102*a* in a transfer bias power supply 102, and the toner which has passed through the process station 1 and has the normal polarity (negative) is transferred to the photosensitive drum 12 in the process station 2 to be collected to the waste toner tank in the process station 2. At this stage, the toner is substantially collected. However, if an amount of the residual toner is large, all of the toner having the normal polarity (negative) may not be collected by the process station 2 in some cases. The toner which has not been collected by the process station 2 and remains on the transfer belt 8 still has the opposite polarity (positive) or non-polarity or the normal polarity (negative) when passing through the process station 2.

The main cleaning bias (negative) is similarly applied to a transfer roller 53 by changing over a switch 103*a* in a transfer bias power supply 103 in a process station 3, and the toner which has not been transferred on the photosensitive drum 12 in the process station 2 is thereby transferred onto a photosensitive drum 13 in the process station 3 to be colleted in the waste toner tank in the process station 3. As a result, most of the toner having the normal polarity (negative) is collected, and the toner on the transfer belt 8 which has the opposite polarity (positive) or the non-polarity or the normal polarity (negative) but has not been transferred on the photosensitive drum 13 owing to a small amount of the electrostatic charge is charged to have the opposite polarity (positive). As described above, since most of the toner has been already collected in the process stations 1 to 3, there is no toner on the transfer belt 8 but it remains in rare cases.

Further, a sub cleaning bias (positive) is applied by a power supply 104 to a transfer roller 54 in a process station 4, and the toner which has passed through the process station 3 without being transferred and has the opposite polarity (positive) is transferred on a photosensitive drum 14 of a process station 4 to be collected in the waste toner tank. Now, the cleaning of the residual toner on the transfer belt 8 is completed.

As described above, when there are two process stations, i.e., the process station which uses the sub-cleaning bias (positive) having the same polarity (positive) as the polarity (positive) during transfer and another process station which uses the main cleaning bias (negative) having the polarity (negative) opposite from the polarity (positive) during transfer, both biases of which is used as the cleaning bias applied to the transfer rollers 51 to 54 of the process stations 1 to 4, the residual toner on the surface of the transfer belt 8 which respectively has the normal polarity (negative) and the opposite polarity (positive) can be collected to the waste toner tanks in the respective process stations 1 to 4 and only a substantially-one rotation (one circle) of the transfer belt 8 can complete cleaning and collection of the residual toner.

As mentioned above, according to this embodiment, the residual toner on the transfer belt 8 can be collected in a short period of time (in which the transfer belt 8 rotates through only one revolution).

Additionally, as compared with the case where the transfer belt is rotated several times for cleaning, a wear of the photosensitive drums 11 to 14 caused by a cleaning blade and the transfer belt 8 or degradation of the toner on a developing sleeve or in a developing device can be reduced.

It is to be noted that the charging polarity of the toner is negative; the sub cleaning bias having the same polarity as that during transfer is set to +1 kV; and the main cleaning bias having the polarity opposite from that during transfer is set to −2 kV in this embodiment.

When applying the sub cleaning bias and when applying the main cleaning bias, the surface of the photosensitive drum is charged (to a potential (shadow potential) equal to that during the usual image formation) by a primary charger, and the residual toner is transferred on the charged surface. Incidentally, when applying the main claning bias, the CPU may control in such a manner that the potential of the photosensitive drum surface becomes a highlight potential (exposing section potential) having an absolute value lower than that of the potential during the usual image formation or a zero potential by image exposing means. By doing so, the absolute value of the main cleaning bias can be small, and the size of the power supply can be prevented from being increased, thereby reducing the cost.

In the above description, during cleaning the transfer belt 8, the cleaning biases which are sequentially applied to the transfer rollers 51 to 54 by the power supply are the sub cleaning bias, the main cleaning bias, the main cleaning bias and the sub-cleaning bias in the order from the upstream side.

Incidentally, it is enough if the cleaning bias applied to at least one of the transfer rollers 51 to 54 is the main cleaning bias and another bias is the sub-cleaning bias.

Therefore, as another example of the cleaning biases applied to the transfer rollers 51 to 54, the following combinations of the biases sequentially applied in the order from the upstream side can be used (in the order of the process stations 1 to 4).

The sub cleaning bias, the main cleaning bias, the sub cleaning bias, and the main cleaning bias.

The sub cleaning bias, the main cleaning bias, the sub cleaning bias, and the sub cleaning bias.

The sub cleaning bias, the main cleaning bias, the main cleaning bias, and the main cleaning bias.

The sub cleaning bias, the sub cleaning bias, the main cleaning bias and the main cleaning bias.

The sub cleaning bias, the sub cleaning bias, the sub cleaning bias, and the main cleaning bias.

The sub cleaning bias, the sub cleaning bias, the main cleaning bias, and the sub cleaning bias.

In addition, if the main cleaning bias and the sub cleaning bias are mixed, the above may include a combination in which process stations applying no cleaning bias exist, e.g., the sub cleaning bias, no cleaning bias, the main cleaning bias, and no cleaning bias.

Figure 4:
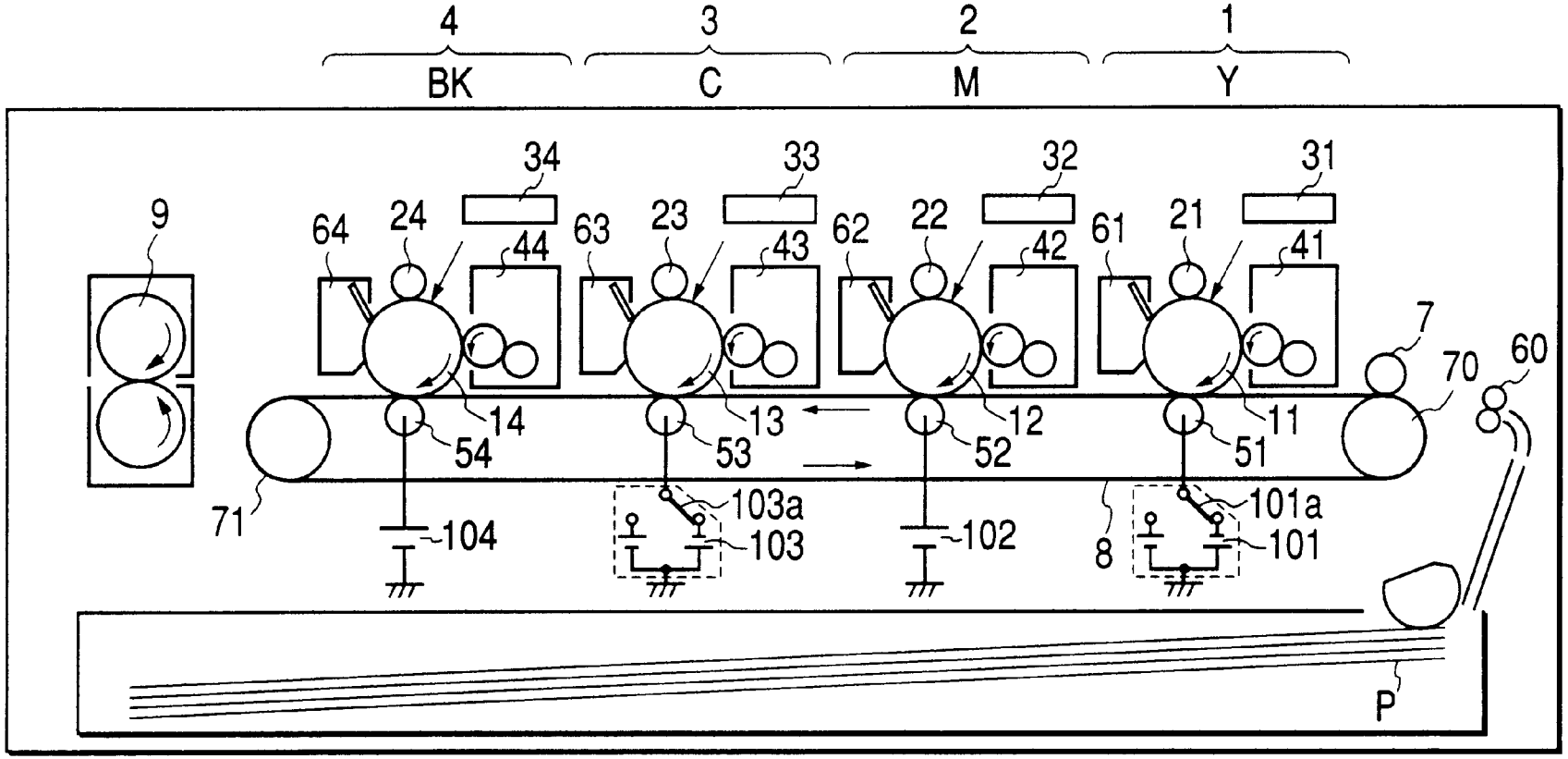
FIG. 4 is a schematic cross-sectional view showing an image forming apparatus according to the embodiment 3.
Figure 5:
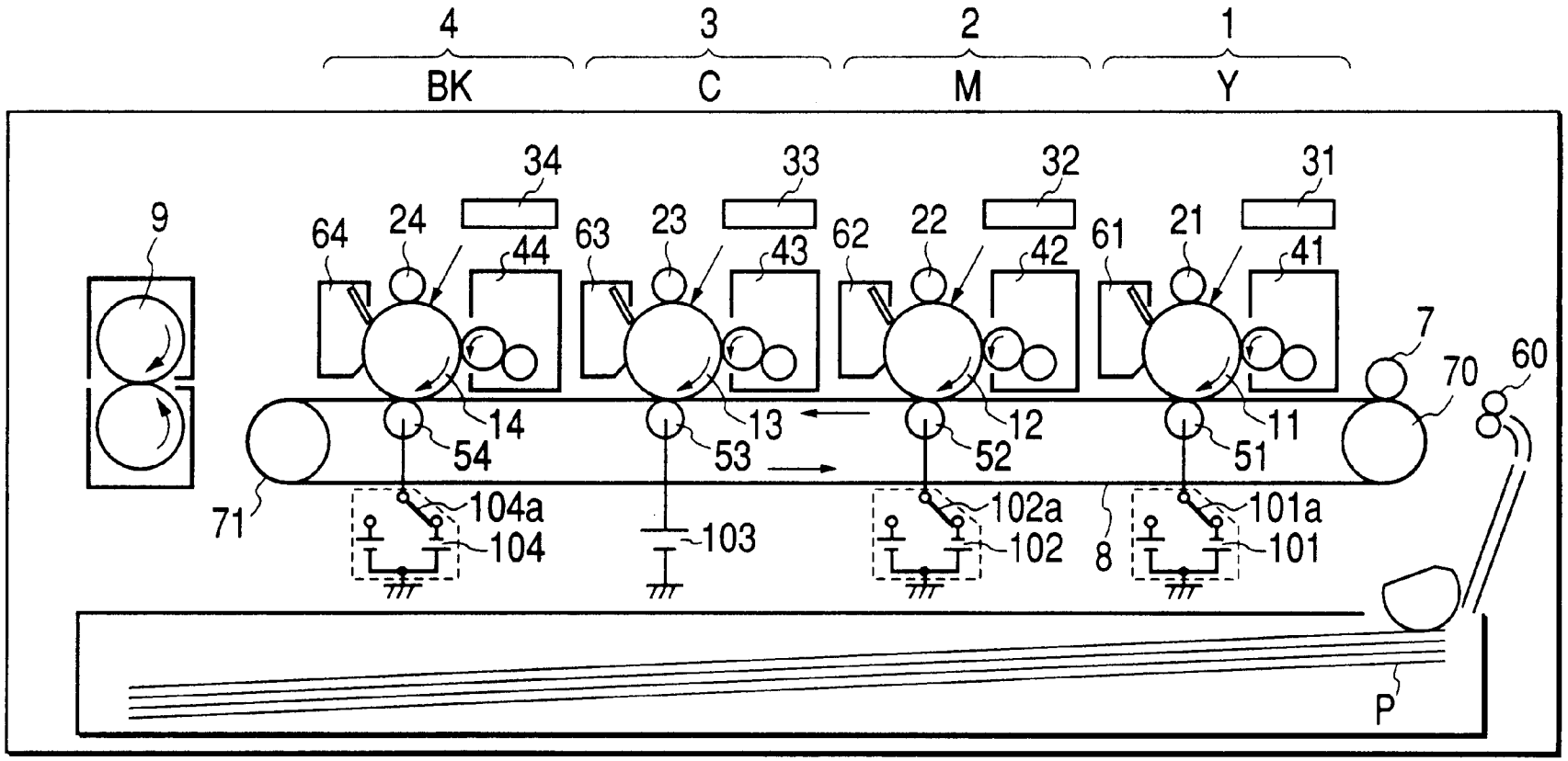
FIG. 5 is a schematic cross-sectional view showing an image forming apparatus according to the embodiment 3.

Further, as an example different from the image forming apparatus shown in FIGS. 4 and 5, the combinations of the biases sequentially applied in the order of the transfer roller 51 to 54 may be as follows.

The main cleaning bias, the sub cleaning bias, the main cleaning bias, and the main cleaning bias.

The main cleaning bias, the main cleaning bias, the main cleaning bias, and the sub cleaning bias.

The main cleaning bias, the sub cleaning bias, the sub cleaning bias, and the main cleaning bias.

The main cleaning bias, the main cleaning bias, the sub cleaning bias, and the sub cleaning bias.

The main cleaning bias, the sub cleaning bias, the sub cleaning bias, and the sub cleaning bias.

Furthermore, if the main cleaning bias and the sub cleaning bias are mixed, the above may include a combination in which the process station applying no cleaning bias exists, e.g., the main cleaning bias, no cleaning bias, and sub cleaning bias, and no cleaning bias.

Additionally, in the developing device, a constant electric charge is given to the toner. However, a small amount of the toner to which the sufficient electric charge is not given (fogging toner on background) or the toner whose polarity is reversed (opposite toner) may occur.

Such toner as the fogging toner adheres to Vd portions (non-image forming section (shadow potential section)) of the photosensitive drums 11 to 14 charged by the primary charging rollers 21 to 24 and further adheres onto the photosensitive drums 11 to 14.

When transferring the toner onto the transfer material, the transfer bias is positive. Even if the opposite toner (positive) adheres onto the photosensitive drums 11 to 14, the opposite toner is not transferred to the transfer material. However, if the fogging toner on background (negative) adheres to the photosensitive drums 11 to 14, the fogging toner is transferred to the transfer material.

Therefore, it is preferable to adopt the structure by which the fogging toner on background hardly adheres. In order to achieve this, there is a measure such as that a difference in potential (back contrast) between the Vd portion and the developing sleeve is set large, for example. However, this structure causes the fogging toner on background to rarely adhere to the photosensitive drums 11 to 14 but the opposite toner to easily adhere to the photosensitive drums 11 to 14.

With this structure, when cleaning of the transfer belt 8 is carried out with the main cleaning bias in a system in which the opposite toner readily adheres to the photosensitive drums 11 to 14, a small amount of the opposite toner is disadvantageously transferred on the transfer belt 8.

As a countermeasure, in a system in which the fogging toner is generated, after the above-described cleaning using the main cleaning bias and the sub cleaning bias (after cleaning during at least one circle of the transfer belt), the cleaning bias applied to the transfer rollers 51 to 54 is changed over to the sub cleaning bias having the same polarity as that (positive) during transfer to complete the cleaning process (performed over at least one circle of the transfer belt), which enables collection of the opposite fogging toner generated in execution of cleaning by application of the main cleaning bias from the transfer belt, thus advancing to the next transfer process.

As described above, in this embodiment, the residual toner on the transfer belt 8 can be excellently cleaned, and the usability on replacement of the process cartridge can be improved by controlling an amount of the residual toner on the transfer belt which is to be collected to the photosensitive drum (waste toner tank) as similar to the embodiment 1.

Figure 6:
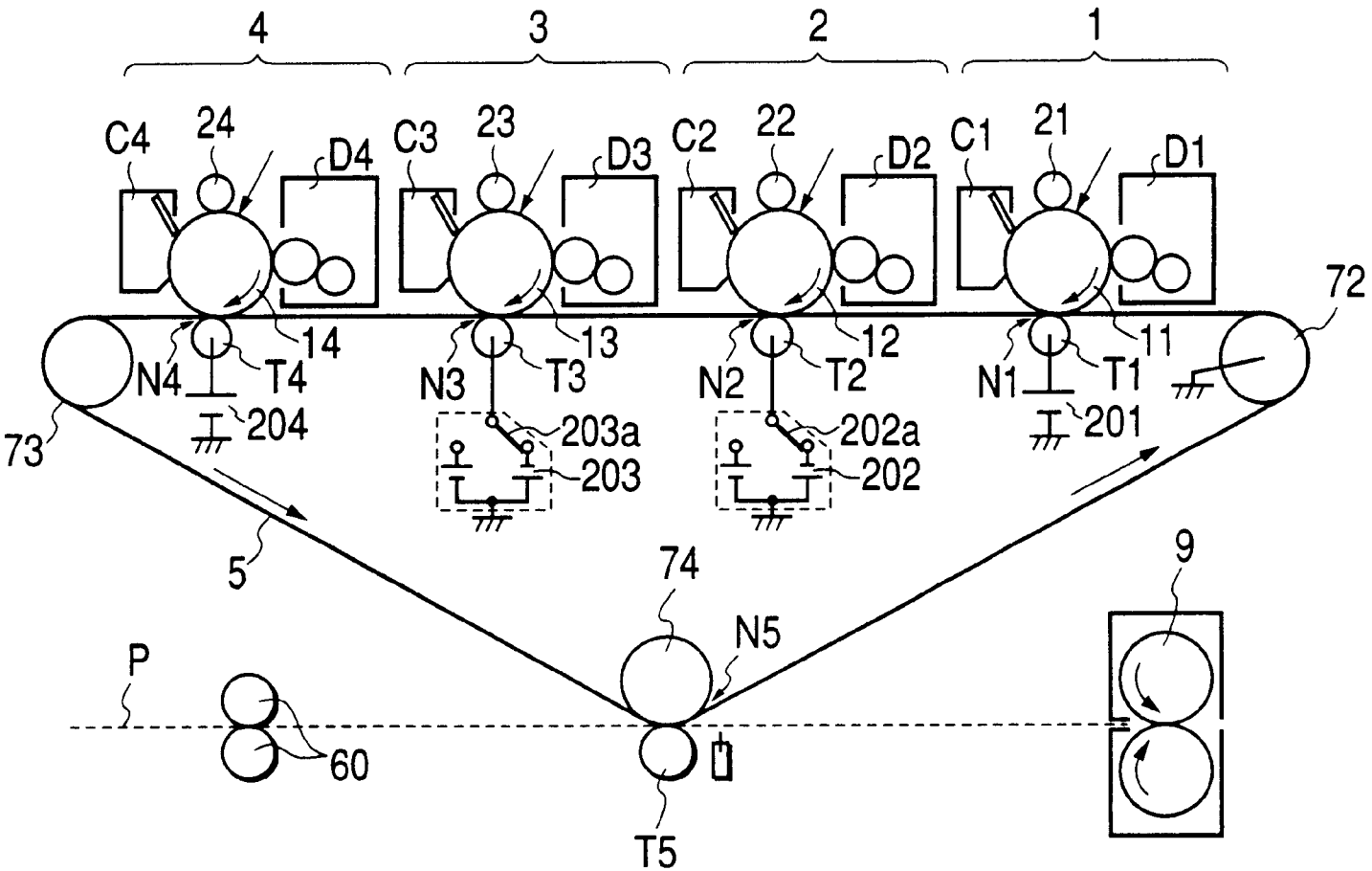
FIG. 6 is a schematic cross-sectional view showing an image forming apparatus according to the embodiment 3.

Although description has been given as to the application to the image forming apparatus having the transfer belt 8 in this embodiment, the present invention is not restricted thereto, and it can be similarly applied to, e.g., an image forming apparatus having the intermediate transfer belt 5 shown in FIG. 6. For example, FIG. 6 shows an example where, in cleaning of the residual toner on the intermediate transfer belt 5, the sub cleaning bias, the main cleaning bias, the main cleaning bias, and the sub cleaning bias are sequentially applied by power supplies 201 to 204 in the order of the primary transfer rollers T1 to T4.

Further, in this embodiment, an amount (including zero) of the residual toner which is transferred from the transfer belt or the intermediate transfer belt to the photosensitive drum may be controlled by controlling the intensity of an electric field formed between the transfer rollers 51 to 54 or the primary transfer rollers T1 to T4 and the respective photosensitive drums.

Embodiment 4

Figure 7:
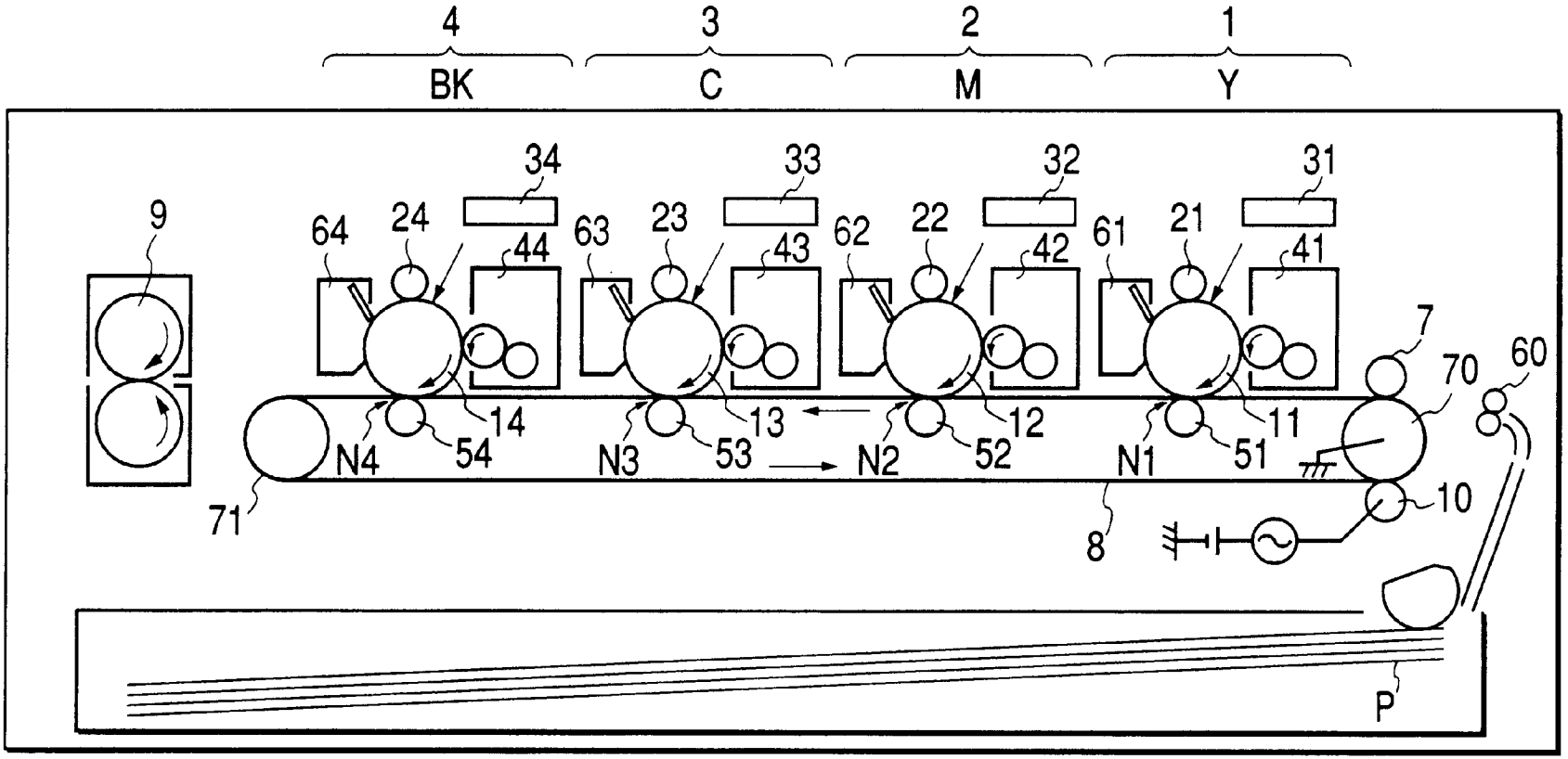
FIG. 7 is a schematic cross-sectional view showing an image forming apparatus according to an embodiment 4.

As opposed to the foregoing embodiment 1, this embodiment is characterized in that the residual toner on the transfer belt 8 is charged by using a charging device 10 in advance as shown in FIG. 7.

After the transfer process, the residual toner remaining on the transfer belt 8 partially includes toner whose charging polarity is opposed or whose electrostatic charge amount is reduced.

Consequently, the charging device 10 (charging roller) is used to charge the residual toner on the transfer belt 8 to a predetermined polarity (positive in this embodiment) in order to collect the toner remaining on, adhered to or formed on the transfer belt 8 (which will be generically referred to as the residual toner hereinafter). Here, an alternating voltage obtained by superimposing a DC voltage and an AC voltage is applied to the charging device 10 so that the charging device 10 is charged to a polarity opposite from the normal charging polarity (negative in this embodiment) of the toner in the developing device. Specifically, a direct-current component is added to an alternating-current component having a peak-to-peak voltage Vpp=2.5 kV, a frequency of 2000 Hz, a duty ratio of 80% on a positive polarity side and 20% on a negative polarity side in order that an intermediate value of the peak voltage becomes substantially 0 V. This alternating-current component causes the residual toner to reciprocate at a gap between the transfer belt 8 and the charging device 10 so that the toner can be further uniformly oppositely-charged. The residual toner charged to the opposite polarity is carried to primary transfer nips N1 to N4 so as to be counter-transferred to the photosensitive drums 11 to 14 by the transfer rollers 51 to 54 to which a predetermined voltage (positive voltage) has been applied. Thereafter, the residual toner is removed by cleaning devices 61 to 64 and accumulated in the waste toner tank in each cleaning device.

In this manner, by charging the residual toner on the transfer belt 8 in advance, an amount of the residual toner which is to be counter-transferred to each photosensitive drum can be surely controlled and grasped. That is, an amount of the residual toner to be collected to the waste toner tank in each photosensitive drum can be controlled and comprehended.

Figure 8:
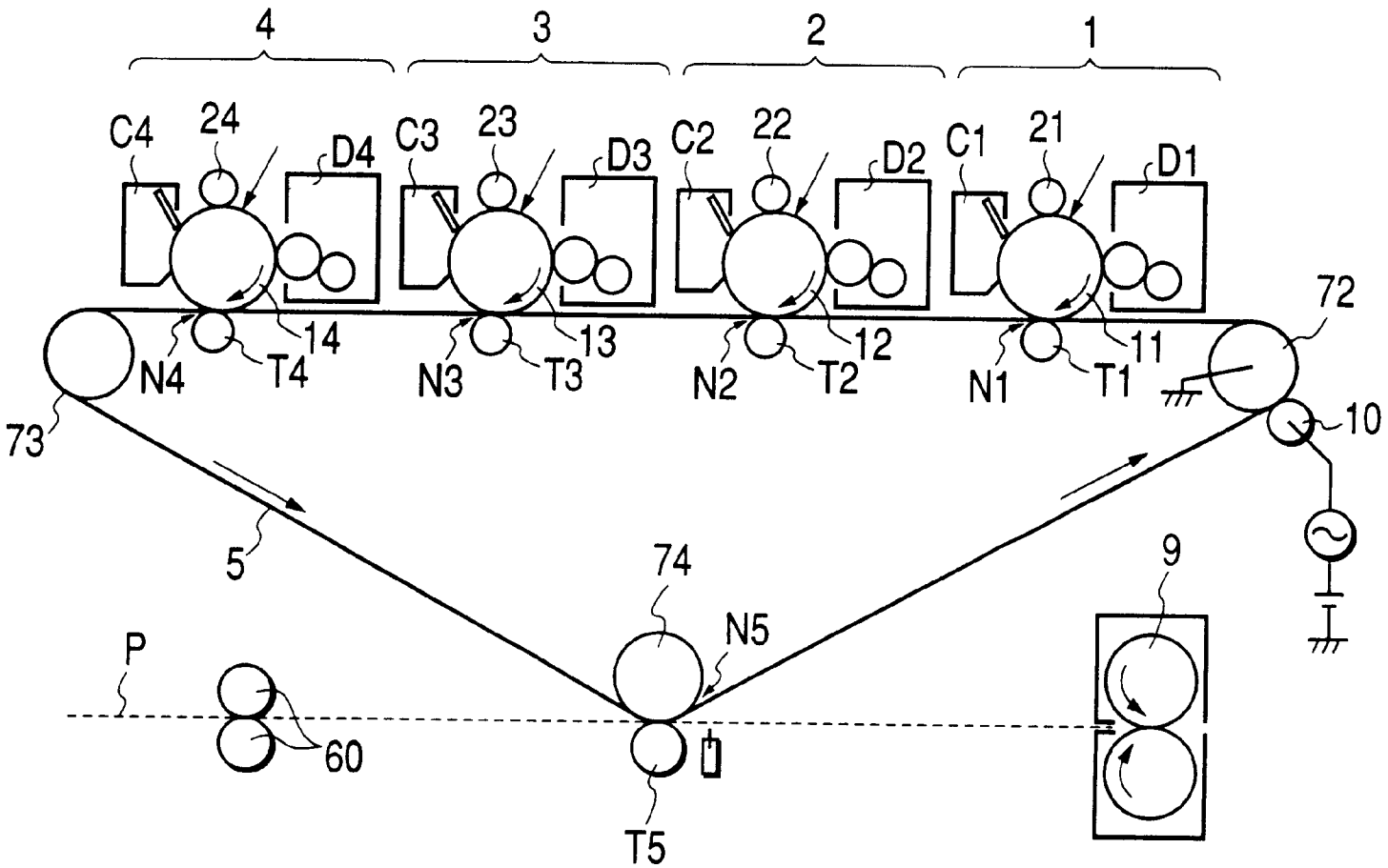
FIG. 8 is a schematic cross-sectional view showing an image forming apparatus according to the embodiment 4.

Further, the present invention can be similarly applied to an image forming apparatus having an intermediate transfer belt 5 shown in FIG. 8.

This embodiment will now be described in detail hereunder.

Secondary transfer residual toner remaining on the intermediate transfer belt 5 after secondary transfer is carried to a charging device 10 (recharging roller) so that it is charged to a polarity (positive) opposite from the normal charging polarity of the toner in the developing device by the charging device 10 to which an alternating voltage obtained by superimposing a DC voltage on an AC voltage. The charged residual toner is supplied to a nip section N1 between a photosensitive drum 11 and the intermediate transfer belt 5 and transferred to the photosensitive drum 11 by applying to the transfer roller T1 a predetermined voltage (positive) having a polarity opposite from the normal charging polarity-of the toner. The residual toner is then collected by a cleaning device C1 to be contained in the waste toner tank. In this example, a surface potential of the photosensitive drum 11 is 0V (bias-off by a charging roller 21).

Here, the detailed description will be given on cleaning of the residual toner on the intermediate transfer belt 5. As to the secondary transfer residual toner on the intermediate transfer belt 5, there is also the toner remaining on the intermediate transfer belt 5 which has been affected by the strong electric field having a polarity opposite from the normal charging polarity of the toner when transferred from the intermediate transfer belt 5 to the transfer material P so that it is charged to the opposite polarity.

However, all of the remaining toner is not charged to the opposite polarity, and there partially exists the toner which is neutralized to have no electrostatic charge or the toner maintaining the normal polarity. Thus, the bias in which an alternating component having a peak-to-peak voltage Vpp is superimposed to a direct-current component is applied to the charging device 10 which is provided after the secondary transfer section. Specifically, the direct-current component is applied to the alternating-current component having the peak-to-peak voltage Vpp=2.5 kV, a frequency of 2000 Hz, a duty ratio of 80% on a positive polarity side and 20% on a negative polarity side so that an intermediate value of the peak-to-peak voltage becomes substantially 0 V. This alternating-current component causes the secondary transfer residual toner to reciprocate at a gap between the intermediate transfer belt 5 and a roller member of the charging device and to be further uniformly oppositely-charged. The secondary transfer residual toner charged to the opposite polarity is carried to the primary transfer nip N and counter-transferred to the photosensitive drum of a process cartridge selected by the CPU. Thereafter, the secondary transfer residual toner is removed by the cleaning device to be accumulated in the waste toner tank in the cleaning device.

In this manner, by charging the residual toner on the intermediate transfer belt 5 in advance, an amount of the residual toner to be counter-transferred to each photosensitive drum can be further accurately controlled and grasped. That is, an amount of the residual toner to be collected in the waste toner tank for each photosensitive drum can be controlled and comprehended, and the residual toner can be prevented from being biasedly collected to a specific waste toner tank.

Figure 9:
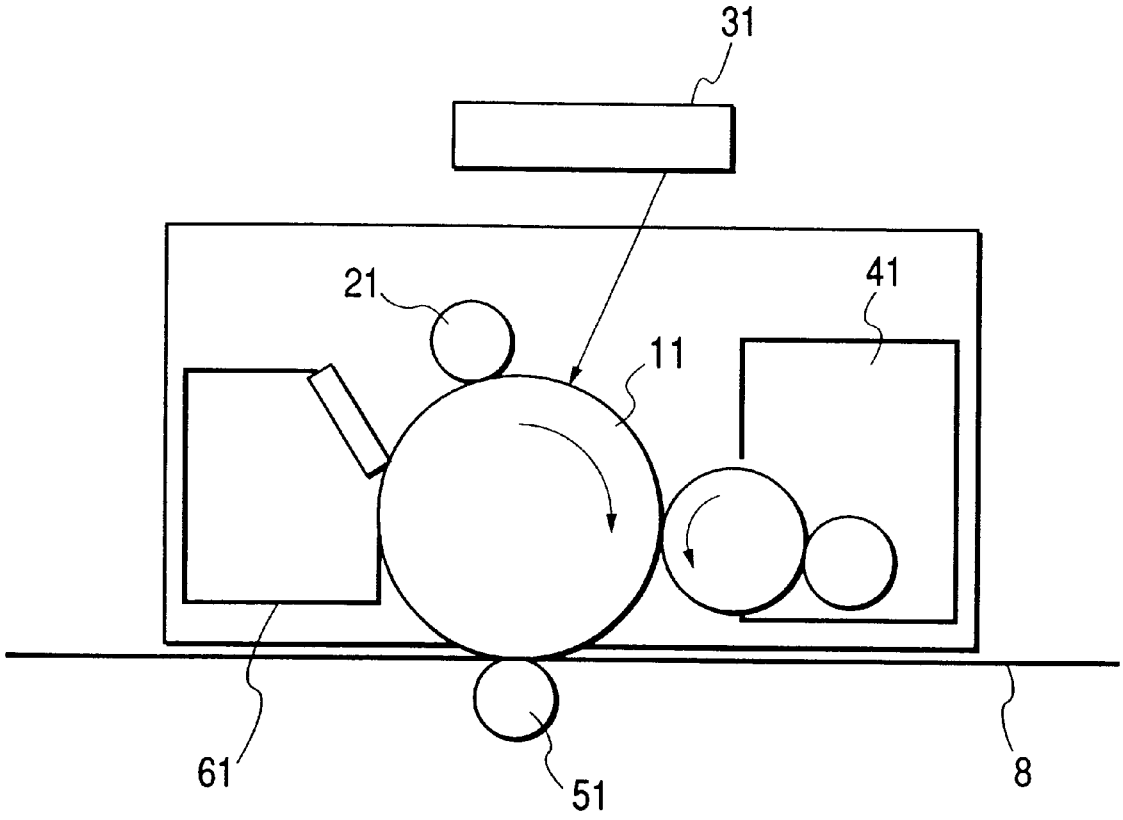
FIG. 9 is a schematic cross-sectional view showing a process station.

In the above-described embodiments 1 to 4, the description has been given as to the example where the photosensitive drum, the primary charger, the developing device and the cleaning device (the waste toner tank and the cleaning blades) are integrally incorporated to form the process cartridge and the process cartridge can be detachably mountable to a main body of the image forming apparatus. One example is shown in FIG. 9. FIG. 9 shows the detail of the process station 1 in FIG. 1. Such a structure can facilitate the replacement operation which will be required due to the life expiration of the photosensitive drum or a short of the toner.

It is to be noted that the process cartridge is sufficient as long as it includes at least the photosensitive drum and the cleaning device.

The present invention is not restricted to the embodiments described above, and various modifications are possible within the scope of the present invention.

What is claimed is:

1. An image forming apparatus comprising:

a plurality of image bearing members each of which bears a toner image;

a moving member;

a plurality of transfer means for electrostatically transferring the toner image on each of said plurality of image bearing members to said moving member or a transfer material borne by said moving member;

a plurality of collecting means each of which collects toner on a corresponding one of said plurality of image bearing members; and selecting means for selecting an image bearing member from among said plurality of image bearing members, wherein toner on said moving member is transferred to the image bearing member selected by said selecting means.

2. The image forming apparatus according to claim 1, further comprising controlling means for controlling an intensity of an electric field formed in a transfer position of each of said plurality of transfer means when toner on said moving member is to be transferred to the image bearing member selected by said selecting means.

3. The image forming apparatus according to claim 2, wherein said controlling means controls a voltage to be applied to each of said plurality of transfer means in order to transfer toner on said moving member to the image bearing member selected by said selecting means.

4. The image forming apparatus according to claim 2, wherein said controlling means controls a surface potential of each of said plurality of image bearing members in order to transfer toner on said moving member to the image bearing member selected by said selecting means.

5. The image forming apparatus according to claim 4, further comprising a plurality of charging means for charging a surface of each of said plurality of image bearing members, said controlling means controlling a voltage to be applied to each of said plurality of charging means.

6. The image forming apparatus according to claim 4, further comprising a plurality of exposing means for exposing a charged surface of each of said plurality of image bearing members, said controlling means controlling an exposure operation by each of said plurality of exposing means.

7. The image forming apparatus according to claim 3, wherein said controlling means controls a surface potential of each of said plurality of image bearing members in order to transfer toner on said moving member to the image bearing member selected by said selecting means.

8. The image forming apparatus according to claim 7, further comprising a plurality of charging means for charging a surface of each of said plurality of image bearing members, said controlling means controlling a voltage to be applied to each of said plurality of charging means.

9. The image forming apparatus according to claim 7, further comprising a plurality of exposing means for exposing a charged surface of each of said plurality of image bearing members, said controlling means controlling an exposure operation by each of said plurality of exposing means.

10. The image forming apparatus according to claim 1, further comprising detecting means for detecting an amount of toner collected in each of said plurality of collecting means, said selecting means selecting the image bearing member, to which toner on said moving member is to be transferred, from among said plurality of image bearing members based on a detection result of said detecting means.

11. The image forming apparatus according to claim 1, further comprising a plurality of developing means for developing latent images on said plurality of image bearing members with toner; and detecting means for detecting an amount of unused toner; and detecting means for detecting an amount of unused toner in each of said plurality of developing means, said selecting means selecting the image bearing member, to which toner on said moving member is to be transferred, from among said plurality of image bearing members based on a detection result of said detecting means.

12. The image forming apparatus according to claim 1, further comprising detecting means for detecting a number of transfer materials on which toner images are formed, said selecting means selecting the image bearing member, to which toner on said moving member is to be transferred, from among said plurality of image bearing members based on a detection result of said detecting means.

13. The image forming apparatus according to claim 1, wherein said selecting means selects the image bearing member, to which toner on said moving member is to be transferred, from among said plurality of image bearing members based on image information associated with original information.

14. The image forming apparatus according to claim 1, wherein each of said plurality of collecting means includes a tank for containing therein toner transferred from said moving member to the corresponding one of said plurality of image bearing members.

15. The image forming apparatus according to one of claims 1 to 10 or 12 to 14, further comprising a plurality of process cartridges each of which includes at least the corresponding one of said plurality of image bearing members and a corresponding one of said plurality of collecting means and is detachably mountable to a main body of said image forming apparatus.

16. The image forming apparatus according to claim 15, wherein each of said plurality of process cartridges includes developing means for developing a latent image on the corresponding one of said plurality of image bearing members with toner.

17. The image forming apparatus according to claim 16, wherein unused toner is contained in said developing means.

18. The image forming apparatus according to claim 1, further comprising toner charging means for charging toner on said moving member to a predetermined polarity, toner on said moving member charged by said toner charging means being transferred to the image bearing member selected by said selecting means.

19. The image forming apparatus according to claim 18, wherein said toner charging means charges toner on said moving member to the predetermined polarity opposite from a normal charging polarity of toner.

20. The image forming apparatus according to claim 19, wherein a voltage having a polarity opposite from the normal charging polarity of toner is applied to said plurality of transfer means for transferring toner on said moving member charged by said toner charging means to the image bearing member selected by said selecting means.

21. The image forming apparatus according to claim 1, wherein toner images transferred from said plurality of image bearing members to said moving member are electrostatically transferred to said transfer material.

22. The image forming apparatus according to claim 1, further comprising detecting means for detecting a density of a toner image for detection which has been transferred from each of said plurality of image bearing members to said moving member, said toner image for detection being transferred to the image bearing member selected by said selecting means after detection of the density of said toner image for detection by said detecting means.

23. The image forming apparatus according to claim 22, wherein a density of the toner image to be formed on each of said plurality of image bearing members is controlled based on a detection result of said detecting means.

24. The image forming apparatus according to claim 1, further comprising detecting means for detecting a position of a toner image for detection which has been transferred from each of said plurality of image bearing members to said moving member, said toner image for detection being transferred to the image bearing member selected by said selecting means after detection of the position of said toner image for detection by said detecting means.

25. The image forming apparatus according to claim 24, wherein a timing for forming a toner image on each of said plurality of image bearing members is controlled based on a detection result of said detecting means.

26. The image forming apparatus according to claim 1, wherein a full-color image is formed on said moving member or said transfer material born by said moving member.

27. An image forming apparatus comprising:

a first image bearing member for bearing a toner image;

first collecting means for collecting toner on said first image bearing member;

a second image bearing member for bearing a toner image;

second collecting means for collecting toner on said second image bearing member;

a moving member;

first transfer means for electrostatically transferring the toner image on said first image bearing member to said moving member or a transfer material borne by said moving member at a first transfer position; and second transfer means for electrostatically transferring the toner image on said second image bearing member to said moving member or said transfer material borne by said moving member at a second transfer position, wherein a direction of an electric field formed at said first transfer position for transferring toner on said moving member to said first image bearing member is opposed to a direction of an electric field formed at said second transfer position for transferring toner on said moving member to said second image bearing member.

28. The image forming apparatus according to claim 27, further comprising controlling means for controlling the direction of said electric field formed at said first transfer position for transferring toner on said moving member to said first image bearing member and the direction of said electric field formed at said second transfer position for transferring toner on said moving member to said second image bearing member.

29. The image forming apparatus according to claim 28, wherein said controlling means controls voltage to be applied to said first transfer means and said second transfer means.

30. The image forming apparatus according to claim 28, wherein said controlling means controls surface potentials of said first image bearing member and said second image bearing member.

31. The image forming apparatus according to claim 30, further comprising first charging means and second charging means for respectively charging surfaces of said first image bearing member and said second image bearing member, said controlling means controlling voltage to be applied to said first charging means and said second charging means.

32. The image forming apparatus according to claim 30, further comprising first exposing means and second exposing means for respectively exposing surfaces of said first image bearing member and said second image bearing member, said controlling means controlling exposure operation by said first exposing means and said second exposing means.

33. The image forming apparatus according to claim 29, wherein said controlling means controls surface potentials of said first image bearing member and said second image bearing member.

34. The image forming apparatus according to claim 33, further comprising first charging means and second charging means for respectively charging surfaces of said first image bearing member and said second image bearing member, said controlling means controlling voltage to be applied to said first charging means and said second charging means.

35. The image forming apparatus according to claim 33, further comprising first exposing means and second exposing means for respectively exposing surfaces of said first image bearing member and said second image bearing member, said controlling means controlling exposure operation by said first exposing means and said second exposing means.

36. The image forming apparatus according to claim 27, further comprising controlling means for controlling an intensity of said electric field formed at said first transfer position for transferring toner on said moving member to said first image bearing member and an intensity of said electric field formed at said second transfer position for transferring toner on said moving member to said second image bearing member.

37. The image forming apparatus according to claim 36, wherein said controlling means controls voltage to be applied to said first transfer means and said second transfer means.

38. The image forming apparatus according to claim 36, wherein said controlling means controls surface potentials of said first image bearing member and said second image bearing member.

39. The image forming apparatus according to claim 38, further comprising first charging means and second charging means for respectively charging surfaces of said first image bearing member and said second image bearing member, said controlling means controlling voltage to be applied to said first charging means and said second charging means.

40. The image forming apparatus according to claim 38, further comprising first exposing means and second exposing means for respectively exposing surfaces of said first image bearing member and said second image bearing member, said controlling means controlling exposure operation by said first exposing means and said second exposing means.

41. The image forming apparatus according to claim 38, wherein said controlling means controls surface potentials of said first image bearing member and said second image bearing member.

42. The image forming apparatus according to claim 41, further comprising first charging means and second charging means for respectively charging surfaces of said first image bearing member and said second image bearing member, said controlling means controlling voltage to be applied to said first charging means and said second charging means.

43. The image forming apparatus according to claim 41, further comprising first exposing means and second exposing means for respectively exposing surfaces of said first image bearing member and said second image bearing member, said controlling means controlling exposure operation of said first exposing means and said second exposing means.

44. The image forming apparatus according to claim 27, further comprising: a third image bearing member for bearing a toner image; third collecting means for collecting toner on said third image bearing member; and third transfer means for electrostatically transferring said toner image on said third image bearing member onto said moving member or said transfer material borne by said moving member.

45. The image forming apparatus according to claim 44, wherein toner images are sequentially transferred from said first image bearing member, said second image bearing member and said third image bearing member onto said moving member or said transfer material borne by said moving member.

46. The image forming apparatus according to claim 44, further comprising selecting means for selecting at least two image bearing members, to which toner on said moving member is to be transferred, from among said first, second and third image bearing members.

47. The image forming apparatus according to claim 44, further comprising detecting means for detecting an amount of toner collected in each of said first, second and third collecting means; and selecting means for selecting at least two image bearing members, to which toner on said moving member is to be transferred, from among said first, second and third image bearing members based on a detection result of said detecting means.

48. The image forming apparatus according to claim 44, further comprising: a plurality of developing means for developing a latent image on each of said first, second and third image bearing members with toner; detecting means for detecting an amount of unused toner in each of said plurality of developing means; and selecting means for selecting at least two image bearing members, to which toner on said moving member is to be transferred, from among said first, second and third image bearing members based on a detection result of said detecting means.

49. The image forming apparatus according to claim 44, further comprising: detecting means for detecting a number of transfer materials on which toner images are formed; and selecting means for selecting at least two image bearing members, to which toner on said moving member is to be transferred, from among said first, second and third image bearing members based on a detection result of said detecting means.

50. The image forming apparatus according to claim 44, further comprising selecting means for selecting at least two image bearing members, to which toner on said moving member is to be transferred, from among said first, second and third image bearing members based on image information associated with original information.

51. The image forming apparatus according to claim 27, wherein each of said first and second collecting means includes a tank for containing therein toner transferred from said moving member to a corresponding one of said first and second image bearing members.

52. The image forming apparatus according to claim 28, wherein said controlling means controls an intensity of said electric field formed at said first transfer position for transferring toner on said moving member to said first image bearing member and an intensity of said electric field formed at said second transfer position for transferring toner on said moving member to said second image bearing member.

53. The image forming apparatus according to one of claims 27 to 47 or 49 to 52, further comprising a plurality of process cartridges each of which includes at least a corresponding one of said image bearing members and a corresponding one of said collecting means and is detachably mountable to a main body of said image forming apparatus.

54. The image forming apparatus according to claim 53, wherein each of said plurality of process cartridges includes developing means for developing a latent image on the corresponding one of said image bearing members with toner.

55. The image forming apparatus according to claim 54, wherein said developing means contains unused toner.

56. The image forming apparatus according to claim 27, wherein the toner image transferred from said first and second image bearing members to said moving member are electrostatically transferred to said transfer material.

57. The image forming apparatus according to claim 27, wherein, after transferring the toner image on said first image bearing member to said moving member or said transfer material borne by said moving member, the toner image on said second image bearing member is transferred to said moving member or said transfer material borne by said moving member.

58. The image forming apparatus according to claim 27, wherein, after said electric fields are formed at said first transfer position and said second transfer position for a predetermined period of time, a voltage having a polarity opposite from a normal charging polarity of toner is applied to said first transfer means and said second transfer means for a predetermined period of time.

59. The image forming apparatus according to claim 58, wherein a voltage having the polarity opposite from the normal charging polarity of toner is applied to said first transfer means and said second transfer means during at least one revolution of said moving member.

60. The image forming apparatus according to claim 27, wherein the electric fields are formed at said first transfer position and said second transfer position during at least one revolution of said moving member.

* * * * *

UNITED STATES PATENT AND TRADEMARK OFFICE

CERTIFICATE OF CORRECTION

PATENT NO. : 6,473,574 B1
DATED : October 29, 2002
INVENTOR(S) : Masatake Usui et al.

It is certified that error appears in the above-identified patent and that said Letters Patent is hereby corrected as shown below:

Column 11,
Line 31, “of” should be deleted and “is” should read -- are --.

Column 14,
Line 46, “polarity-of” should read -- polarity of --.

Signed and Sealed this

Twenty-fifth Day of March, 2003

JAMES E. ROGAN
*Director of the United States Patent and Trademark Office*